US006367880B1

(12) United States Patent
Niederman et al.

(10) Patent No.: US 6,367,880 B1
(45) Date of Patent: Apr. 9, 2002

(54) MODULAR UPHOLSTERED FURNITURE CONSTRUCTION

(75) Inventors: Alfred G. Niederman, 946 Rollingwood Rd., Highland Park, IL (US) 60035; Travis D. Pate, Booneville, MS (US)

(73) Assignee: Alfred G. Niederman, Highland Park, IL (US)

( * ) Notice: Subject to any disclaimer, the term of this patent is extended or adjusted under 35 U.S.C. 154(b) by 0 days.

(21) Appl. No.: 09/435,165

(22) Filed: Nov. 5, 1999

(51) Int. Cl.[7] ..... A47C 7/00

(52) U.S. Cl. ..... 297/440.14; 297/440.16; 297/440.22

(58) Field of Search ..... 297/440.1, 440.14, 297/440.15, 440.16, 440.22

(56) References Cited

U.S. PATENT DOCUMENTS

| | | | | |
|---|---|---|---|---|
| 2,593,270 A | | 4/1952 | Clifton | |
| 2,793,685 A | | 5/1957 | Spitz | 155/196 |
| 3,171,690 A | | 3/1965 | Weiss | |
| 3,774,966 A | | 11/1973 | Faulkner et al. | 297/440 |
| 3,929,375 A | | 12/1975 | Gans | 297/440 |
| 4,043,591 A | | 8/1977 | Lehmann | 297/248 |
| 4,148,106 A | * | 4/1979 | Gallien | |
| 4,234,976 A | | 11/1980 | Litkewycz | |
| 4,305,616 A | * | 12/1981 | Martinez | |
| 5,080,438 A | | 1/1992 | Moyer | 297/440 |
| 5,169,211 A | * | 12/1992 | Inaba et al. | |
| 5,263,764 A | | 11/1993 | Laughlin et al. | 297/440.23 |
| 5,338,095 A | | 8/1994 | Laughlin et al. | 297/440.1 |
| 5,394,573 A | | 3/1995 | Laughlin et al. | 5/18.1 |
| 5,423,596 A | | 6/1995 | Laughlin et al. | 297/440.1 |
| 5,529,380 A | | 6/1996 | Blansett | 297/452.18 |
| 5,551,757 A | | 9/1996 | Glover | 297/440.23 |
| 5,678,897 A | | 10/1997 | Prestia | 297/440.15 |
| 5,795,028 A | * | 8/1998 | Dussia, Jr. et al. | |

FOREIGN PATENT DOCUMENTS

| | | |
|---|---|---|
| FR | 1391940 | 1/1964 |

* cited by examiner

*Primary Examiner*—Milton Nelson, Jr.
(74) *Attorney, Agent, or Firm*—Greer, Burns & Crain, Ltd.

(57) ABSTRACT

An easily assembled and disassembled modular furniture system is disclosed. The furniture system includes a base frame having a front member, a first side member, a second side member and a rear member. A plurality of furniture modules including a first arm module, a second arm module and one of a spring nest module and a sleeper module are mounted to the base frame using a plurality of fastener assemblies. Each fastener assembly includes two portions: a stud member and an aligning receptacle bracket. Each of the stud members and said brackets are secured to opposing locations of the base frame and at least one of the modules so that the modules may be positioned upon the frame by engaging the aligning receptacle brackets upon the corresponding stud members without the use of tools.

17 Claims, 5 Drawing Sheets

MODULAR UPHOLSTERED FURNITURE CONSTRUCTION

BACKGROUND OF THE INVENTION

Low cost modular furniture is desired by both consumer and retailer alike. The furniture must be lightweight yet sturdy, and easy to produce. Such modules should be constructed so that they are easy to ship, thus reducing transportation costs. In addition, consumers desire furniture which would allow them to easily replace or recover modules which have become worn, stained or have gone out of style, without great cost or inconvenience. There is also a market for furniture that may be converted from a conventional sofa to a sleeper sofa easily and quickly.

Modular furniture is known in the art but has not been a commercial success. U.S. Pat. No. 5,529,380, which is incorporated by reference, discloses a modular furniture system that allows the furniture unit to be disassembled, and even the covering changed. However, the process required to effect these changes is time consuming and possibly confusing to a homeowner who is not handy with tools. In a hotel or motel setting, where furniture modules would be changed relatively frequently, this would make routine furniture maintenance more expensive.

Further, assembly of conventional modular furniture requires that brackets be lined up and held in place while bolts are installed, making it difficult for an individual to complete the task without the assistance of an additional person. The prior art designs lack the ability to have the modules held in alignment with the frame so that the assembler has both hands free to operate the bolt without having to realign the module.

It is an object of this invention to provide an improved system of modular furniture that may be assembled quickly and easily by an individual.

It is a further object of this invention to provide an improved system of modular furniture with self-aligning brackets that may be assembled without requiring the use of tools.

It is still another object of this invention to provide improved modular furniture that may be shipped economically because the component parts can be packed flat and compactly.

It is yet another object of the present invention to provide a system of modular furniture which is easily convertible between a sofa and a sleeper.

BRIEF SUMMARY OF THE INVENTION

The above-listed objects are met or exceeded by the present invention, which features a self-aligning fastener assembly with a system of modular furniture that can be assembled and disassembled by an individual without the use of tools.

More specifically, the present invention provides an easily assembled and disassembled modular furniture system. Each unit or article of furniture includes a base frame having a front member, two side members, and a rear member. A plurality of furniture modules include arm modules, a backrest module and one of a spring nest module and a sleeper module mounted to the frame. The modules are attached to the frame and/or each other with a plurality of fastener assemblies, each fastener assembly including two portions: a stud member and an aligning receptacle bracket. One of the portions, either the stud member or the aligning receptacle bracket, are secured to opposing locations of the base frame and at least one of the modules. The modules may be positioned upon the frame by engaging the aligning receptacle brackets upon the corresponding stud members without the use of tools.

One skilled in the art will readily appreciate that this assembly system allows an individual to easily mount the modules onto the frame. The self-aligning receptacle bracket guides the module into the correct position to receive the stud member. The head of the stud member holds the aligning receptacle bracket in place so that it does not come apart while the remainder of the furniture unit is assembled. With the unit held in alignment with the fastener assemblies, the individual can easily complete the assembly of the furniture by insertion of a few thumbscrews and fastener clips. If desired, conventional threaded fasteners may also be employed and either hand or tool tightened.

Furniture incorporating the present system is also economical and easy to ship because the frame and modules will pack into a smaller space than an assembled unit. The design of the present invention does not require hardware or assemblies that protrude from the unit, making it difficult to pack the modules tightly for shipping. The modules can also be shipped separately, for use as replacement parts if the arms or back of a piece of furniture become stained or damaged.

DETAILED DESCRIPTION OF THE INVENTION

Figure 1:
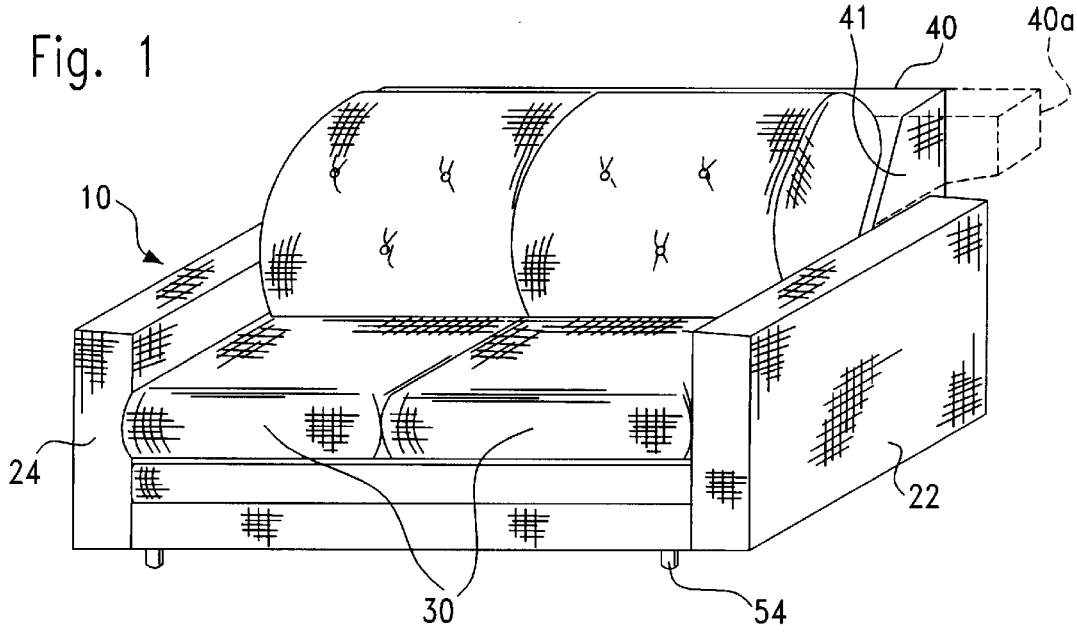
FIG. 1 is a top perspective view of an assembled modular sofa embodying the present invention.
Figure 2:
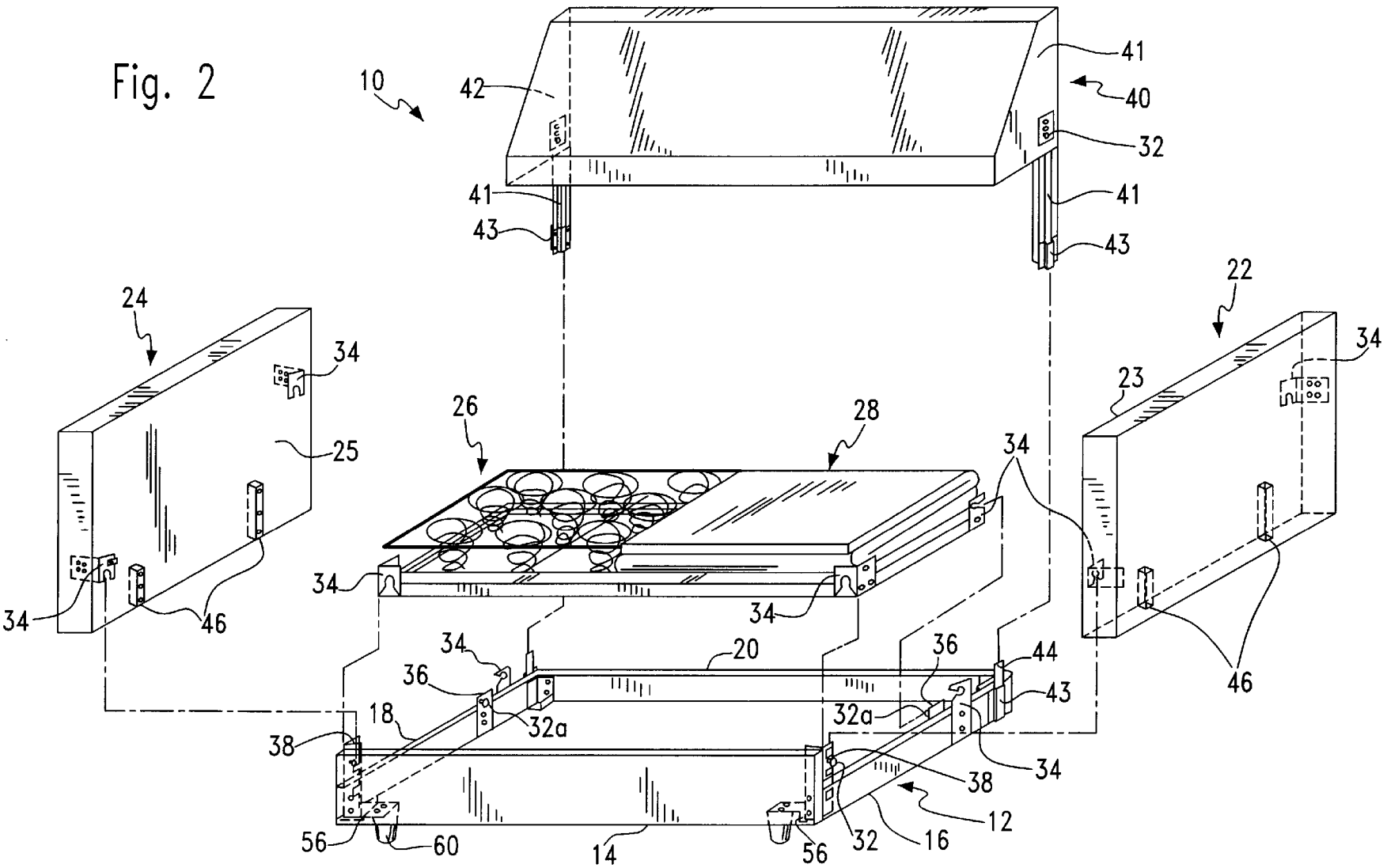
FIG. 2 is an exploded view of the modular sofa of FIG. 1, with portions omitted for clarity.

More specifically, and referring now to FIGS. 1 and 2, the present invention provides an easily assembled and disassembled modular furniture system. FIG. 1 depicts an assembled furniture article or unit, generally designated 10, embodying the invention.

Referring to FIG. 2, the present modular furniture article 10 has a base frame, generally designated 12, having a front member 14, a first side member 16, a second side member 18 and a rear member 20. The base frame 12 provides stability. It can be crafted of wood, metal, plastic or any other materials that may be suitable for this type of construction. Corrugated metal three or five-channel, or through channel bars are the preferred frame materials. With this construction, also described in U.S. Pat. No. 5, 529,380, the metal can be made thinner to reduce weight while maintaining strength.

The front member 14, the first side member 16, the second side member 18 and the rear member 20 are connected to each other using any means known in the art and suitable for the frame material. Fasteners, such nails, screws, nuts or bolts may be used. If, as is preferred, the frame 12 is made of metal, it may be welded together. Plastic or wooden materials may be glued or bonded, provided the resulting frame has sufficient strength to be useful for furniture articles. Brackets may be added in the comers to connect the members to each other and to add stability to the base frame 12. Plastic or metal base frames 12 may be formed or cast in one piece, wherein the front member 14, the first side member 16, the second side member 18 and the rear member 20 are each one side of the one-piece base frame 12.

As an option, the front member 14 may optionally be upholstered to match the finished furniture article 10. However, the front member 14 may also be painted, stained, dyed or finished in other ways that are consistent with the style and finish of the furniture article 10.

A plurality of furniture modules including a first arm module 22, a second arm module 24 and one of a spring nest module 26 and a sleeper module 28 are mounted on and supported by the base frame. Either a spring nest 26 or a sleeper module 28 (shown diagrammatically in hybrid form, and also collectively referred to as a seat suspension module) may be mounted under seat cushions 30 of the furniture article 10. If conventional furniture is desired, the spring nest 26 provides support for the seat cushions 30. Where it is desirable to have a pull-out mattress, the sleeper module 28 is used for conversion of the article 10 into a bed. As is known in the art, the sleeper module 28 may be used in a chair to form a single bed, or with a sofa to make a larger bed. The furniture article 10 may be quickly and conveniently converted from a chair or sofa by removal of the first arm module 22 and the second arm module 24, then replacing the spring nest 26 with the sleeper module 28.

More specifically, the first arm module 22 includes an arm frame arranged in the general shape of the module. It can be crafted of wood, corrugated metal, plastic or any other materials that may be suitable for this type of construction. Upholstery may be applied as desired in any manner known in the art. Often, cardboard, foam padding or other filler material may be placed upon and about the frame to add firmness to the side of arm module 22. Of the module 22 may first be covered with cardboard and then foam padding beneath to give the upholstery a cushiony feel. Additional layers or types of foam or padding may be applied to the portion of the frame of the arm module 22 upon which the user will rest his arm for additional comfort. Each arm module 22 and 24 has a corresponding inner surface 23 and 25 that is in contact with and mounted to the base frame 12. The second arm module 24 is a mirror image of the first arm module 22, and is made of the same construction.

In the preferred embodiment, the furniture article 10 also includes a backrest module 40. Having an upholstered frame, the frame can be made of wood, corrugated metal, plastic or any equivalent, suitable rigid ad durable materials. Size and style of the finished furniture article 10 will determine the exact size and shape of the backrest module 40. However, it must be of a general shape to provide comfortable support for the user when seated on the furniture article 10. The backrest module 40 has a first side 41 and a second side 42, and is preferably configured to fit between the first and second arm modules 22, 24 such that the arm modules partially cover the sides 41 and 42 of the backrest module. In another embodiment 40*a* (shown in phantom), the backrest module 40 has portions of the sides 41, 42 extending laterally over the arm modules 22 and 24, with the backrest module partially covering the top of the arm modules.

The furniture modules 22, 24, 26, 28, 40 are connected by a plurality of fastener assemblies. Each fastener assembly includes two portions: a stud member 32 and a notched aligning receptacle bracket 34. In the preferred embodiment, the stud member 32 and the aligning receptacle bracket 34 are secured to opposing locations on the base frame 12, and also to at least one of the modules 22, 24, 26, 28, 40 so that the modules may be positioned upon the base frame 12 by engaging the notches of the aligning receptacle brackets 34 upon the corresponding stud members 32 without the use of tools. Although this discussion describes primarily the embodiment depicted in the drawings, those skilled in the art will appreciate that the aligning receptacle brackets 34 and the stud members 32 are interchangeable as to which portion is placed on the base frame 12 and which portion is placed on the respective furniture module 22, 24, 26, 28, 40.

Figure 3:
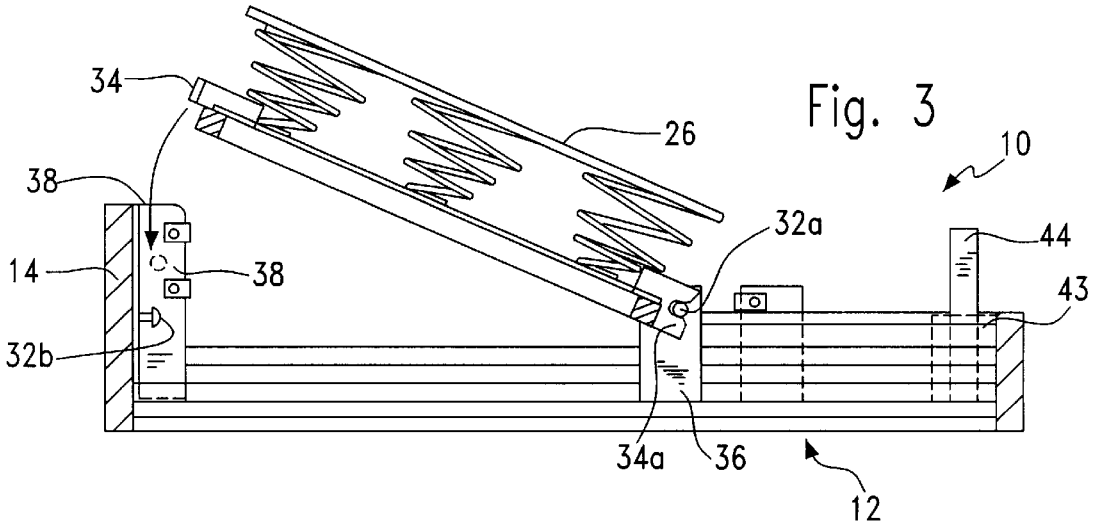
FIG. 3 is a side fragmentary view of the sofa of FIG. 1, depicting the spring nest being installed onto the frame.
Figure 4:
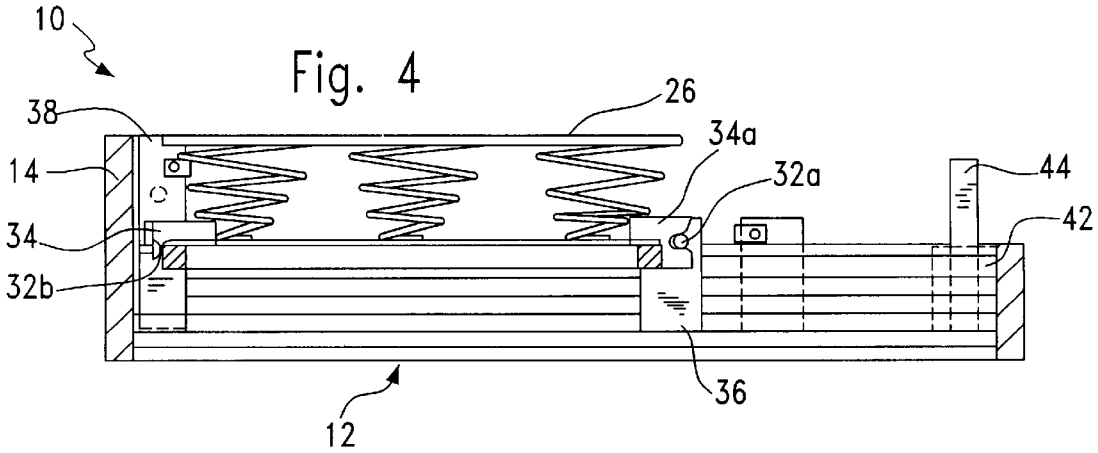
FIG. 4 is a side view, as seen in FIG. 3 depicting the spring nest installed on the frame.

Referring to FIGS. 3 and 4, at least four portions of the aligning receptacle brackets 34 are located on the spring nest 26 or the sleeper module 28. While the following discussion describes the spring nest 26, it is to be understood that the sleeper module 28 is configured for engagement upon the frame 12 in the same way. Two rear brackets 34*a* are located on each side of the spring nest 26 near the rear of the unit, and two front brackets 34 are located on the front of the spring nest near each side of the unit. The rear brackets 34 should be mounted so that the bracket notch 35 will align with the stud member 32*a* when the spring nest 26 is held at an inclined angle to the base frame 12, with the back of the nest toward the base frame 12 best seen in FIG. 3. As is the case with all of the stud members 32 and the receptacle brackets 34, the aligning receptacle brackets 34*a* are preferably an integral part of the spring nest 26, and may alternatively be attached as a separate piece to the spring nest or the frame 12. In the preferred embodiment, the aligning receptacle bracket 34*a* is mounted to the outside of the spring nest 26. The front aligning receptacle brackets 34 on the spring nest 26 are of similar construction, but are arranged such that the bracket notch 35 will align with the stud member 32 when the bracket is placed on the stud from above.

The corresponding stud members 32*a* are located on the base frame 12. Two rear stud members 32*a* are located on the inside of each of the first side member 16 and the second side member 18, in proper position to align with the rear aligning receptacle brackets 34*a* on the spring nest 26. In the preferred embodiment, each stud member 32*a* is an integral part of a frame-to-nest bracket 36, which is mounted in the inside of the base frame 12.

Two additional front stud members 32*b* are mounted at the front member 14 of the base frame 12. The front stud members 32*b* are preferably mounted at each end of the front member 14 to provide stability to the spring nest 26. A front comer bracket 38 is preferably provided to support the junction of the frame front member 14 with the side member 14 and 16. In addition, the front comer bracket 38 secures the stud members 32*b* to the inside of the base frame 12 at the intersection of each of the first side member 16 and the second side member 18 with the front member 14.

Installation of the spring nest 26 onto the base frame 12 is easily accomplished by a single individual. The individual holds the spring nest 26 at an inclined position to the base frame 12 with the rear aligning receptacle brackets 34*a* toward the base frame 12. He then engages the rear aligning receptacle brackets 34*a* of the spring nest 26 with the rear stud members 32*a* of the base frame 12. With the rear stud members 32 engaged, the spring nest 26 is pivoted about this engagement and lowered until the front aligning receptacle brackets 34*b* engage the front stud members 32*b*. The front stud members 32*b* thus act as a stop member in the movement of the spring nest 26 or sleeper module 28 as it is rotated into 15 position.

If a change from a seat to a convertible chair or sofa is desired, it is a simple matter to remove the loose cushions 30 from the furniture article 10, lift the front of the spring nest 26 to disengage the front aligning receptacle brackets 34*b* from the front stud members 32*b*, rotate the front of the spring nest upward until the rear aligning receptacle brackets 34*a* are disengaged from the rear stud members 32*a*. The process is then reversed to put sleeper module 28 in place and replace the loose cushions 30. The conversion from a chair or sofa to a sleeper unit may be accomplished by one individual without tools in only a few minutes.

Figure 5:
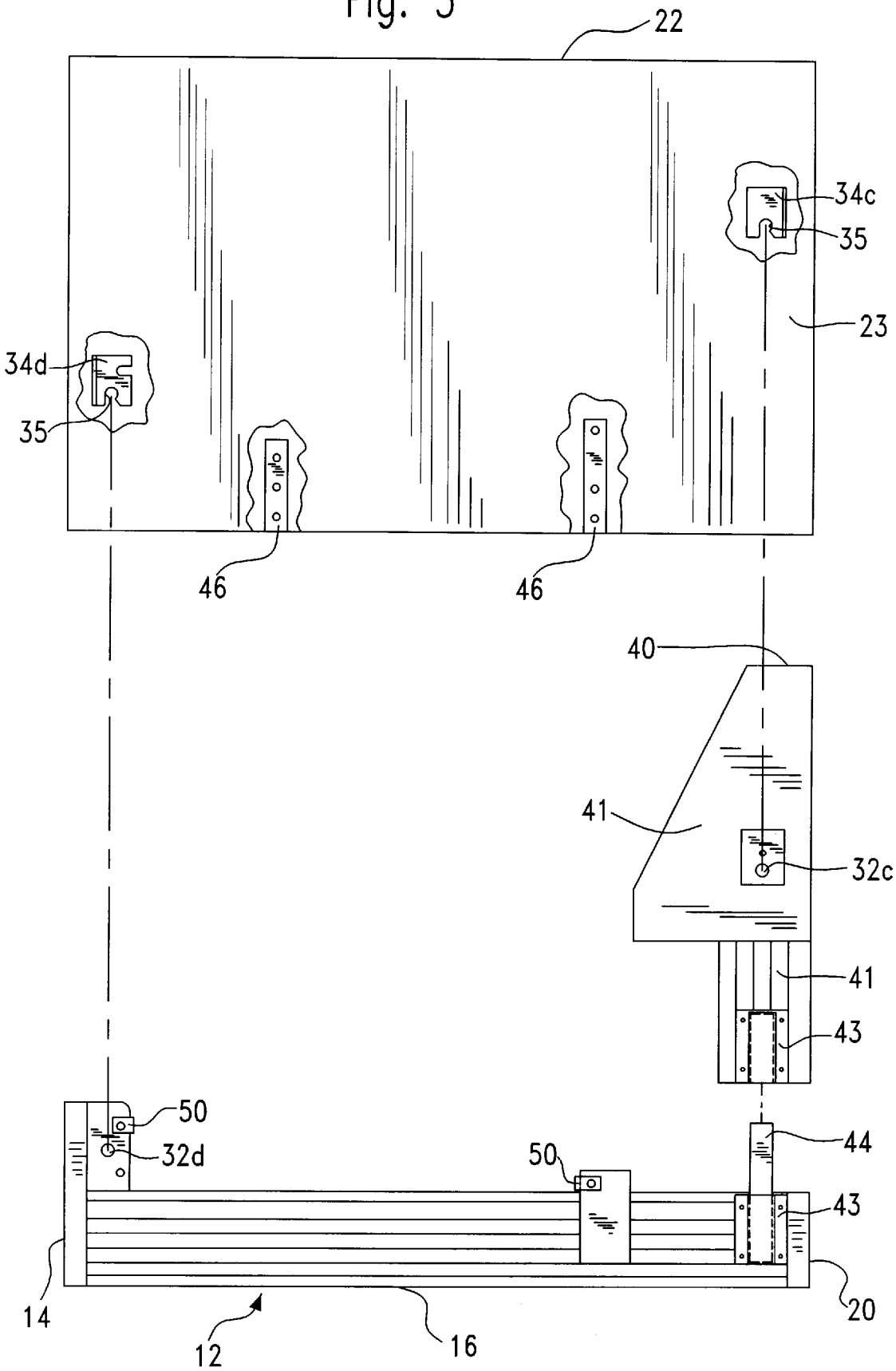
FIG. 5 is an exploded side view of the sofa of FIG. 1, depicting the arm module and the backrest module before installation.

Referring now to FIGS. 2–6, the backrest module 40 is mounted to the base frame 12 by a backrest fastener assembly on each side of the base frame (shown best in FIG. 5). This assembly includes opposing sheath brackets 43 on the base frame 12 and the backrest module 40. The opposing sheath brackets 43 define a chamber, into which is inserted a bar 44 configured for insertion into the chamber.

When assembling the furniture article 10, the backrest module 40 is mounted to the frame 12 by inserting the bar 44 into the sheath bracket 43 on each side of the base frame. Then, the sheath bracket 43 mounted on a depending leg 41 of the backrest module 40 is fitted over the bar 44 and moved in a downward direction until the two sheath brackets 43 contact each other (best seen in FIG. 6). Thus, this portion of the assembly is completed without the use of tools. This engagement of the backrest module 40 upon the base frame 12 is a preliminary location and is not locked until arm modules 22, 24 are secured to the base frame. It is contemplated that the exact placement of the opposing sheath brackets 43 may change to suit the application and the construction of the backrest module 40. For example, the sheath brackets 43 may be equally effective when mounted on the back member 20 of the base frame 12.

The arm modules 22 and 24 are also mounted to the base frame 12 with fastener assemblies. Although the following discussion describes the first arm module 22, it is to be understood that the second arm module 24 is a mirror image of the first arm module, and attaches to the furniture article 10 in the same way. Referring to FIG. 5, the first arm module 22 has at least two aligning receptacle brackets 34*c*, 34*d* mounted to the inner surface 23. Each of the aligning receptacle brackets should be mounted to the base frame 12 or other sturdy portion of the arm module 22 so that it will support the weight of an individual if they sit on the arm of the furniture article 10. Greater stability of the arm module 22 will also be gained by spacing the aligning receptacle brackets 34*c*, 34*d* apart from each other. It is preferred that one of the aligning receptacle brackets 34*d* be mounted on the inner surface 23 near the front of the furniture article 10 and the other aligning receptacle bracket 34*c* be mounted near the rear of the article. Both of the aligning receptacle brackets 34*c*, d should be positioned so that they will align with corresponding stud members 32*c*, and 32*d* when the arm module 22 is lowered onto the base frame 12 as depicted in FIG. 5.

The corresponding stud members 32*c*, and 32*d* are preferably mounted on the base frame 12 or, in the case the stud member 32*c* on one of the arm modules 22, 24. Again, for stability, it is preferable to mount the stud members 32*c* and 32*d* with one toward the front of the furniture article 10 and one stud member toward the back of the article. When mounting the front stud member 32*d*, it is preferable to mount it on the side member 16 of the base frame 12, oriented such that the stud is projecting toward the outside of the base frame 12. In the preferred embodiment shown, the stud member 32*d* is a part of the front comer bracket 38. However, the front stud member 32*d* may also be a part of or attached to the spring nest 26, the sleeper module 28 or any other location that will give sufficient support to the arm member 22. Similarly, the rear stud member 32*c* may be attached to or an integral part of the side member 16 of base frame 12, the spring nest 26 or sleeper module 28 or the backrest module 40. Preferably, a rear stud member 32*c* is attached to each of the first and second sides 41, 42 of the backrest module 40.

In the case where the backrest module 40*a* extends out over the arm module 22, the rear fastener assembly must be moved slightly to accommodate the fact that the arm module must be mounted from the front rather than from above. The rear aligning receptacle bracket 34*c* may be located on the top of the arm module 22 and the rear stud member 32*c* may be located under the portion of the backrest module 40 that covers the top of the arm member 22. Here, the both of the aligning receptacle brackets 34*c*, 34*d* must be aligned so that the brackets will align with the stud members 32*c*, 32*d* when the arm module 22 is mounted by sliding the arm module back under the backrest module 40.

Figure 6:
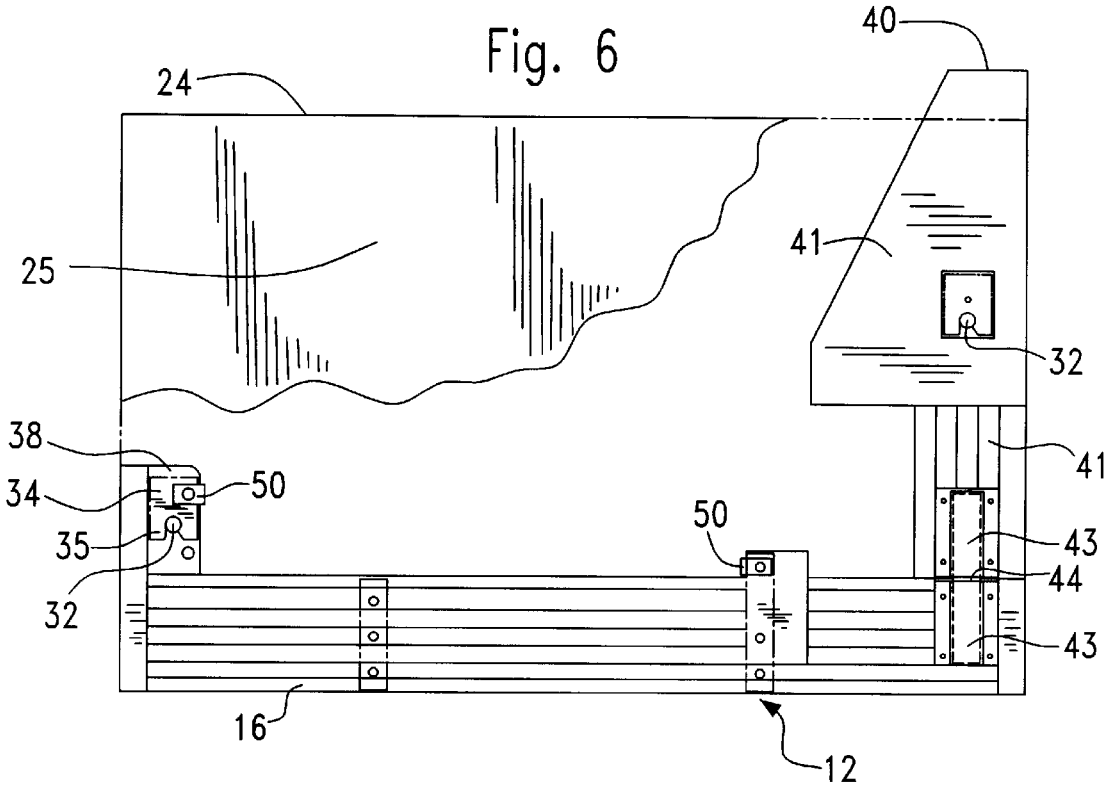
FIG. 6 is a side view as seen in FIG. 5 of the arm module and the backrest module after installation.
Figure 7:
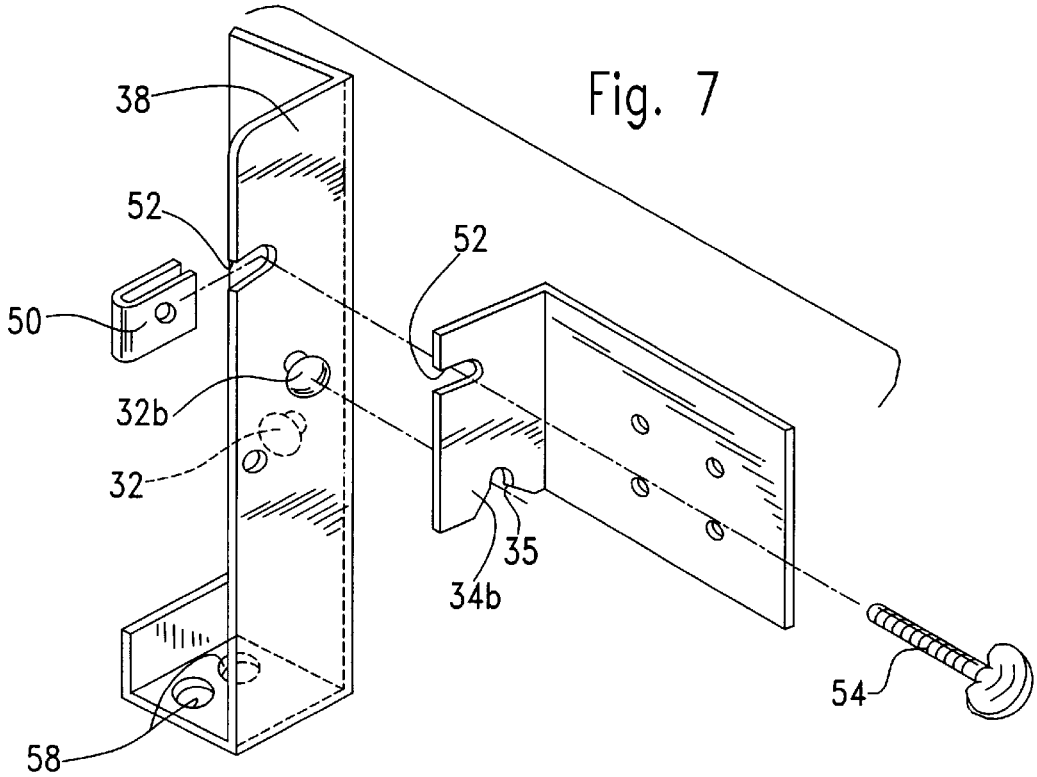
FIG. 7 is an exploded detail view of the front corner bracket as seen in FIG. 6 as it engages front aligning receptacle bracket of the arm module.

Referring now to FIGS. 5–7, to add rigidity to the assembled furniture article 10, it may also include one or more fastener clips 50 on the base frame 12 for receiving a threaded fastener. As shown in FIG. 7, after alignment, the receptacle bracket 34*b* is engaged on the stud member 32*b*, and corresponding slots 52 in the bracket 34 and the base frame 12 bearing clips 50 can be aligned to receive a threaded fastener 54. To maintain the advantage of the present system, that assembly may be achieved without the use of tools, the fastener 54 is preferably a thumb-screw. However, other threaded fastener are also contemplated.

As seen in FIGS. 5 and 6, fasteners 54 and fastener clips 50 may advantageously be used in securing the first arm module 22, the second arm module 24, the spring nest 26 or the sleeper module 28 to the base frame 12. They may also be used to secure furniture modules to each other as in connecting either arm module 22 or 24 to the backrest module 40, to the spring nest 26 or the sleeper module 28.

Referring now to FIGS. 2 and 7, while supports to hold the furniture article 10 at a comfortable level off the floor may be an integral part of the base frame 12 or the comer brackets 38, the preferred embodiment includes optional gooseneck foot brackets 56 (best seen in FIG. 2). One or more apertures 58 for mounting the gooseneck foot brackets 56 are preferably provided in the brackets 56. In the preferred embodiment, the gooseneck bracket 56 laterally offsets the position of a foot 60 from the comer of the base frame 12.

When the desired furniture article 10 is a sofa, the gooseneck foot bracket 56 is preferably mounted such that the feet 60 are positioned under the spring nest 26 or sleeper module 28. In this position, the legs are in a position to distribute the weight if several individuals are seated, limiting the tendency to sag at the midline of the unit. At the same time, if a user of the furniture article 10 sat down on the arm of the sofa, the weight of the furniture article would likely prevent the unit from tipping over, potentially injuring the user. If the desired furniture article is a chair, the gooseneck foot bracket 56 is mounted such that the feet 60 are under the arm modules 22 and 24 of the furniture article 10. When the feet 60 are so mounted, the weight of a user seated on the arm module 22 is less likely to cause the article furniture 10 to tip over.

Figure 8:
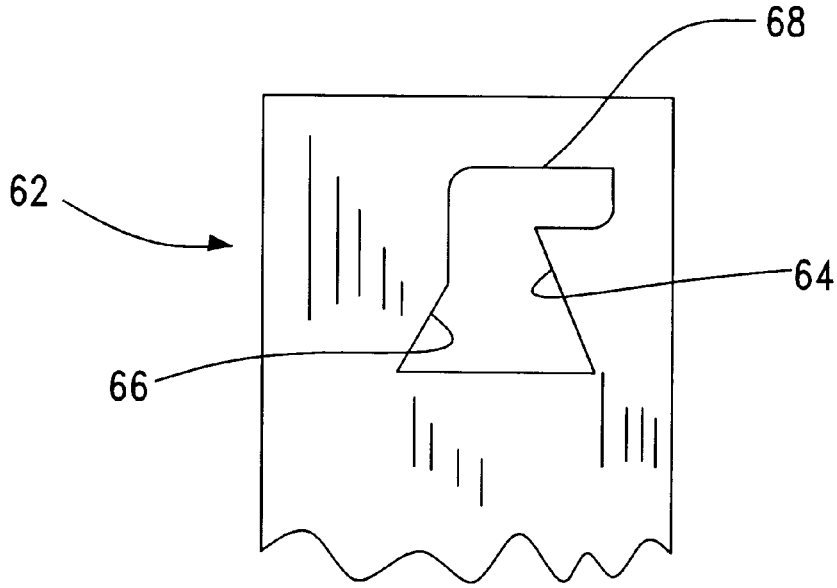
FIG. 8 is a front elevational view of an alternate embodiment of a front arm bracket.
Figure 9:
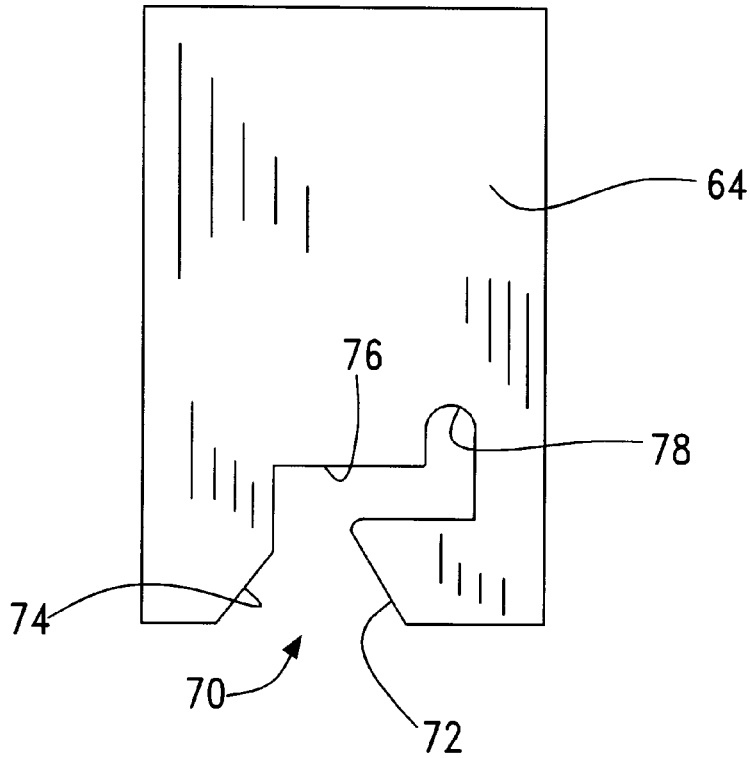
FIG. 9 is a front elevational view of an alternate embodiment of a rear arm bracket.

Referring now to FIGS. 8 and 9, alternate configurations of brackets 34*d* and 34*c* are generally designated as 62 and 64 respectively. The brackets 62 and 64 are mounted to the inner surface 23 of the arm module 22 at the front and rear ends, respectively. A notch 64 of the front bracket 62 has a narrowing portion 66 for facilitating the engagement upon the stud 32*d,* and a laterally and rearwardly projecting portion 68 for accommodating the sliding of the arm module forward relative to the base frame 12. Similarly, the rear bracket 64 has a notch 70 with an open bottom 72 which is in communication with a narrowed portion 74 which also performs a locating function upon engagement with the stud 32*c*. In addition, a laterally and rearwardly projecting portion 76 is in communication with the narrowed portion 74 at a first end, and is also in communication with a slightly vertically extending portion 78.

In operation, when the aim module 22 is equipped with the brackets 62 and 64, the front end is placed against the base frame 12 so that the notch 64 engages the stud 32*d,* and the rear end is placed so that the open end 72 of the notch 70 engages the stud 32*c*. The arm module is then slid laterally forward relative to the base frame, until the stud 32*c* 32*c*. In addition, a laterally and rearwardly projecting portion 76 is in communication with the narrowed portion 74 at a first end, and is also in communication with a slightly vertically extending portion 78.

In operation, when the arm module 22 is equipped with the brackets 62 and 64, the front end is placed against the base frame 12 so that the notch 64 engages the stud 32*d,* and the rear end is placed so that the open end 72 of the notch 70 engages the stud 32*c*. The arm module is then slid laterally forward relative to the base frame, until the stud 32*c* engages the slightly vertically extending portion 78. That occurs as the arm module is dropped slightly so that it rests upon the studs 32*c,* 32*d*. It will be appreciated that the lengths of the laterally extending portions 68 and 76 should be appropriately dimensioned to allow the desired sliding action of the arm module 22 relative to the base frame 12. With this engage and slide configuration, the arm module 22 is more securely locked to the base frame 12, and the number of threaded locking fasteners 54 may be reduced or, in some cases, even eliminated.

While a particular embodiment of the present modular upholstered furniture construction has been shown and described, it will be appreciated by those skilled in the art that changes and modifications may be made there to without departing from the invention in its broader aspects and as set forth in the following claims.

What is claimed is:

1. An easily assembled and disassembled modular furniture system, comprising:

a base frame;

a plurality of furniture modules including a first arm module, a second arm module, a backrest module and a seat suspension module, said seat suspension module having a rear end pivotally engageable on said base frame and a stud member for engaging an aligning receptacle bracket;

a plurality of fastener assemblies having a stud member and an aligning receptacle bracket;

one of said stud member and said bracket being secured to opposing locations of said base frame and at least one of said modules so that said modules may be positioned upon said frame by engaging said aligning receptacle brackets upon said corresponding stud members without the use of tools.

2. A method of assembling the furniture system of claim 1 comprising:

engaging said fastener assemblies secured to said seat suspension module and to said base frame;

rotating said seat suspension module;

engaging a second fastener assembly secured to said seat suspension module and to said base frame;

inserting a bar into a chamber defined by one of two opposing sheath brackets, said opposing sheath brackets being secured to said base frame and a backrest module; and engaging said bar with the other of said opposing sheath brackets; and engaging said fastener assemblies secured to said arm module and to said base frame.

3. The furniture system of claim 1 wherein said brackets have laterally extending notch portions so that at least one of said first and second arm modules are engageable upon said base frame in a sliding looking motion.

4. The furniture system of claim 1 further including a foot mounted on a gooseneck foot bracket and wherein a front member of said base frame is provided with a sofa foot mounting aperture and a chair foot mounting aperture for receiving said gooseneck foot bracket.

5. The furniture system of claim 1 further including at least one stop member on said base frame for engaging said seat suspension module.

6. The furniture system of claim 1 further including at least one fastener clip on said base frame for receiving a threaded fastener.

7. The furniture system of claim 6 wherein each said at least one clip is positioned on said frame for securing said first and second arm modules and said seat suspension module to said base frame.

8. The furniture system of claim 1 further including a backrest module configured for engagement upon said base frame, and a backrest fastener assembly.

9. The furniture system of claim 8 wherein said backrest fastener assembly includes opposing sheath brackets on said base frame and at least one of said modules, said opposing sheath brackets defining a chamber, and a bar configured for insertion into said chamber.

10. The furniture system of claim 8 wherein each said arm module has an inner surface for engaging said base frame, said inner surface including one of said fastener assemblies for engaging said frame and one of said fastener assemblies for engaging said backrest module.

11. The furniture system of claim 10 wherein each of said fastener assemblies on said arm modules is said aligning receptacle bracket.

12. The furniture system of claim 8 wherein said backrest module has a first side and a second side, at least one of said sides being provided with one of said stud member and said aligning receptacle bracket for engagement with a corresponding member on a corresponding one of said first and second arm modules.

13. The furniture system of claim 12 wherein said arm modules extend over a portion of said first side and said second side of said backrest module.

14. The furniture system of claim 12 wherein said backrest module includes a portion that extends over a portion of said arm modules.

15. An easily assembled and disassembled modular furniture system, comprising:

a base frame;

a plurality of furniture modules including a first arm module, a second arm module and a seat suspension module;

a backrest module and a backrest fastener assembly, said backrest fastener assembly includes opposing sheath brackets on said base frame and said backrest module, said opposing sheath brackets defining a chamber, a bar configured for insertion into said chamber;

a plurality of fastener assemblies, each said fastener assembly including two portions: a stud member and an aligning receptacle bracket; and one of said stud member and said bracket being secured to opposing locations of said base frame and at least said arm modules, said backrest modules and said seat suspension module so that said modules maybe positioned upon said frame by engaging said aligning receptacle brackets upon said corresponding stud members without the use of tools.

16. The furniture system of claim 15 further including a foot mounted on a gooseneck foot bracket, and wherein a front member of said base frame is provided with a sofa foot mounting aperture and a chair foot mounting aperture for receiving said gooseneck foot bracket.

17. An easily assembled and disassembled modular furniture system, comprising:

a base frame;

a plurality of furniture modules taken from a group comprised of a first arm module, a second arm module and a backrest module;

at least one fastener assembly for securing at least one of said modules to said base frame, said at least one fastener assembly including opposing sheath brackets on said base frame and on at least one of said modules, said opposing sheath brackets defining a chamber, and a bar configured for insertion into said sheath bracket on one said module, so that upon assembly of adjacent modules, said bar is enclosed within the chamber defined by the opposing sheath brackets.

* * * * *